US006070361A

United States Patent [19]

Paterno

[11] Patent Number: 6,070,361

[45] Date of Patent: Jun. 6, 2000

[54] GARAGE DOOR OPERATING SYSTEM AND METHOD OF OPERATING A GARAGE DOOR

[76] Inventor: Robert S. Paterno, 7846 Albin, Houston, Tex. 77071

[ * ] Notice: This patent issued on a continued prosecution application filed under 37 CFR 1.53(d), and is subject to the twenty year patent term provisions of 35 U.S.C. 154(a)(2).

[21] Appl. No.: 08/987,060

[22] Filed: Dec. 9, 1997

[51] Int. Cl.[7] ..... G08B 13/08

[52] U.S. Cl. ..... 49/14; 49/199

[58] Field of Search ..... 49/14, 13, 25, 49/197, 199, 31

[56] References Cited

U.S. PATENT DOCUMENTS

| | | | |
|---|---|---|---|
| 3,289,350 | 12/1966 | Moody | 49/28 |
| 3,319,696 | 5/1967 | Wiegan | 160/188 |
| 3,436,892 | 4/1969 | Stansberry | 49/358 |
| 3,695,332 | 10/1972 | Bahnsen | 160/188 |
| 4,533,905 | 8/1985 | Leivenzon et al. | 49/14 X |
| 4,583,081 | 4/1986 | Schmitz | 49/14 X |
| 5,003,290 | 3/1991 | Lindquist et al. | 49/14 X |
| 5,027,553 | 7/1991 | Vergara | 49/30 |
| 5,282,337 | 2/1994 | Duhame | 49/199 |
| 5,533,561 | 7/1996 | Forehand, IV | 160/188 |
| 5,565,843 | 10/1996 | Meyvis | 49/13 X |
| 5,713,621 | 2/1998 | Krenkel et al. | 160/10 X |
| 5,752,553 | 5/1998 | Kmiecik et al. | 141/286 |

FOREIGN PATENT DOCUMENTS

| | | | |
|---|---|---|---|
| 397179 | 11/1990 | European Pat. Off. | 49/14 |
| 2241680 | 9/1991 | United Kingdom | 49/14 |

*Primary Examiner*—Jerry Redman
*Attorney, Agent, or Firm*—Gilbreth & Associates, P.C.; J. M. Gilbreth

[57] ABSTRACT

A garage door operating system which includes a garage door, framing along which the garage door is positioned and travels between non-closed and closed positions, a signal generator which transmits a closed and or non-closed signal depending upon the position of the garage door, and finally includes an indicator which provides a suitable indicator signal upon receiving the signal.

6 Claims, 3 Drawing Sheets

GARAGE DOOR OPERATING SYSTEM AND METHOD OF OPERATING A GARAGE DOOR

BACKGROUND OF THE INVENTION

1. Field of the Invention

The present invention relates to a garage door operating system and a method of operating a garage door. In another aspect the present invention relates to a garage door operating system which generates a warning when the garage door is not fully closed and a method of operating a garage door in which a warning is generated when the garage door is not fully closed.

2. Description of the Related Art

Very commonly, a garage door may be operated into an open or closed position by a motorized system which may be activated by a nearby positioned switch, or by a remote controller. A normal cycle of operation is generally as follows.

Upon desiring to leave the residence, a homeowner will first open the garage door either from a switch positioned inside to the garage, or by using a remote controller that is generally left inside the homeowner's automobile. With the garage door in the open position the homeowner is able to drive the automobile out of the garage. Once the automobile is clear of the garage door, the homeowner will then activate the garage door controller to close the garage door.

As a safety feature, most garage door systems, upon engagement with an object, such as a toy, a child or a pet, will stop regardless or reverse the direction of travel of the garage door. This safety feature may also be activated by a malfunction in the travel of the garage door along the track, for example if the door "hangs up" or otherwise becomes stuck. This safety feature may even also be activated by a sensor detecting an object in the travel path of the door, by either a motion detector type sensor, or by the object interrupting a light, laser or infrared beam.

Herein lies the problem. Many homeowners are able to quickly back out of their driveway, hit the remote controller to close the garage door, and be on their merry way in their automobile before ever seeing the garage door come to a fully closed position. The homeowner is then left to wonder, "did my garage door close fully, or did it encounter an object in its travel path on the way down and either stop or return to the open position?" Either of these positions create a security breach of at least the garage if not of the entire residence.

In other instances, the homeowner absentmindedly backs out without activating the garage door remote controller, and while believing that the garage door was closed since that is the homeowner's usual habit, has a nagging suspicion that maybe it was not closed, leaving the homeowner to wonder, "did I remember to close my garage door, and even if I did, did it close fully or did it encounter an object in its travel path on the way down and either stop or return to the open position?". Again, either of these positions create a security breach of at least the garage if not of the entire residence.

The applicant is aware of various patents directed to garage door systems.

U.S. Pat. No. 3,289,350, issued Dec. 6, 1966 to Moody, discloses an extremely light weight and mechanically simple mechanism for the mechanical opening and/or closing of a garage door. This garage door system includes a safety system whereby the full power of the motor will be applied to open the door and only a fraction of the power thereof will be required and applied where any obstruction is encountered during closing movement of the door before the power is disconnected.

U.S. Pat. No. 3,319,696, issued May 16, 1967 to Wiegan, discloses an automatic overhead door opening system. As a safety feature, when the garage door hits an obstruction going up or down or reaches its upper or lower limit, safety means are provided to activate a limit switch and stop the motor.

U.S. Pat. No. 3,436,892, issued Apr. 8, 1969 to Stansberry, discloses an automatic door lock actuator system. Stansberry notes that most power operated garage door closures are belt or chain driven and include a friction clutch to allow drive slippage if the door encounters some unforeseen obstacle in its travel. Stansberry further notes that such slippage also allows the garage door to be forced open by an authorized person and requires the use of some type of separate locking means.

U.S. Pat. No. 3,695,332, issued Oct. 3, 1972 to Bahnsen, discloses a garage door operating mechanism which permits the door to return to a closed position under the urging of gravity. As a safety mechanism should the garage door become stuck or hung-up on some object during its downward travel, the motor will continue running and rotating a reel in its unwinding direction until the reel is rotated through a sufficient angle to actuate a limit switch.

U.S. Pat. No. 5,282,337, issued Feb. 1, 1994 to Duhame, et al, discloses a garage door operator with a pedestrian light control. The improvement of this invention appears to be a light which is turned on for a brief period by the garage door controller each time the operator motor is operated. Furthermore, the pedestrian door to the garage is equipped with a magnetic switch which signals the controller when the pedestrian door is opened, causing the light to be turned on for the preset period.

U.S. Pat. No. 5,533,561, issued Jul. 9, 1996 to Forehand IV, discloses a garage door security system for preventing the unauthorized manual opening of a garage door.

While the various prior art garage door operating systems and methods of operating a garage door provide for safety mechanisms in which when the downwardly traveling garage door encounters an obstruction will either stop or reverse the travel of the garage door, none of these provide to a operator operating a remote garage door controller, an indication of such stopping or reversal of travel, nor provide an indication that the door is open.

Thus there is a need in the art for a garage door operating system and method of operating the garage door.

There is another need in the art for a garage door operating system and method of operating the garage door which will provide an indicator signal that the garage door is open.

There is even another need in the art for a garage door operating system and method of operating the garage door which will provide an indicator signal if the garage door stops, or is reversed in its downward travel path.

These and other needs of the prior art will become apparent to one of ordinary skill in the art upon review of this patent application including the specification drawing and claims.

SUMMARY OF THE INVENTION

It is an object of the present invention to provide a garage door operating system and method of operating the garage door.

It is even another object of the present invention to provide a garage door operating system which will provide an indication that the garage door is open, and method of operating a garage door.

It is another object of the present invention to provide a garage door operating system which will provide an indication that the garage door has closed, and method of operating a garage door.

These and other objects of the present invention will become apparent to one of ordinary skill in the art upon review of this specification its claims and drawings.

According to one embodiment of the present invention, there is provided a garage door operating system. This system may be utilized with a conventional automatic garage door system in which a garage door travels in a track between non-closed and closed positions. A motor and associated mechanical mechanism is operatively linked with the garage door and moves it along the track between the non-closed and closed positions. The motor is typically controlled by a nearby positioned switch, and by a remote controller which is generally left in a vehicle. The system of this embodiment also includes a signal generator which transmits at least one of a closed signal with the garage door in the closed position, or a non-closed signal with the garage door in the non-closed position. The commercially preferred embodiment will utilize a signal generator which transmits a closed signal with the garage in the closed position, and probably only for a limited time after the garage has reached such closed position. Remotely positioned from the garage door is an positioned indicator which upon receipt of the transmitted signal provides an indicator signal indicative of the signal transmitted, that is, a closed or non-closed indication. Preferably, this indicator is mounted in the vehicle, probably on the dash or otherwise in a warning light console, or more preferably, mounted in the remote controller.

According to another embodiment of the present invention, there is provided a method of moving a garage door along a track from a non-closed position to a closed position, the garage door being operatively connected to a motorized system for moving said door along said track. The method generally includes providing a signal which starts the motorized system moving the door from the non-closed position to the closed position. The method further includes transmitting at least one of a closed signal when the garage door is in the closed position, or a non-closed signal when the garage door is in the non-closed position. The method even further includes receiving, at a position remote to the garage door, the transmitted closed or non-closed signal. The method still further includes providing, at the position remote to the garage door, a signal indicative of the signal received closed or non-closed signal.

DETAILED DESCRIPTION OF THE INVENTION

The present invention will now be described with reference to FIGS. 1–3.

Figure 1:
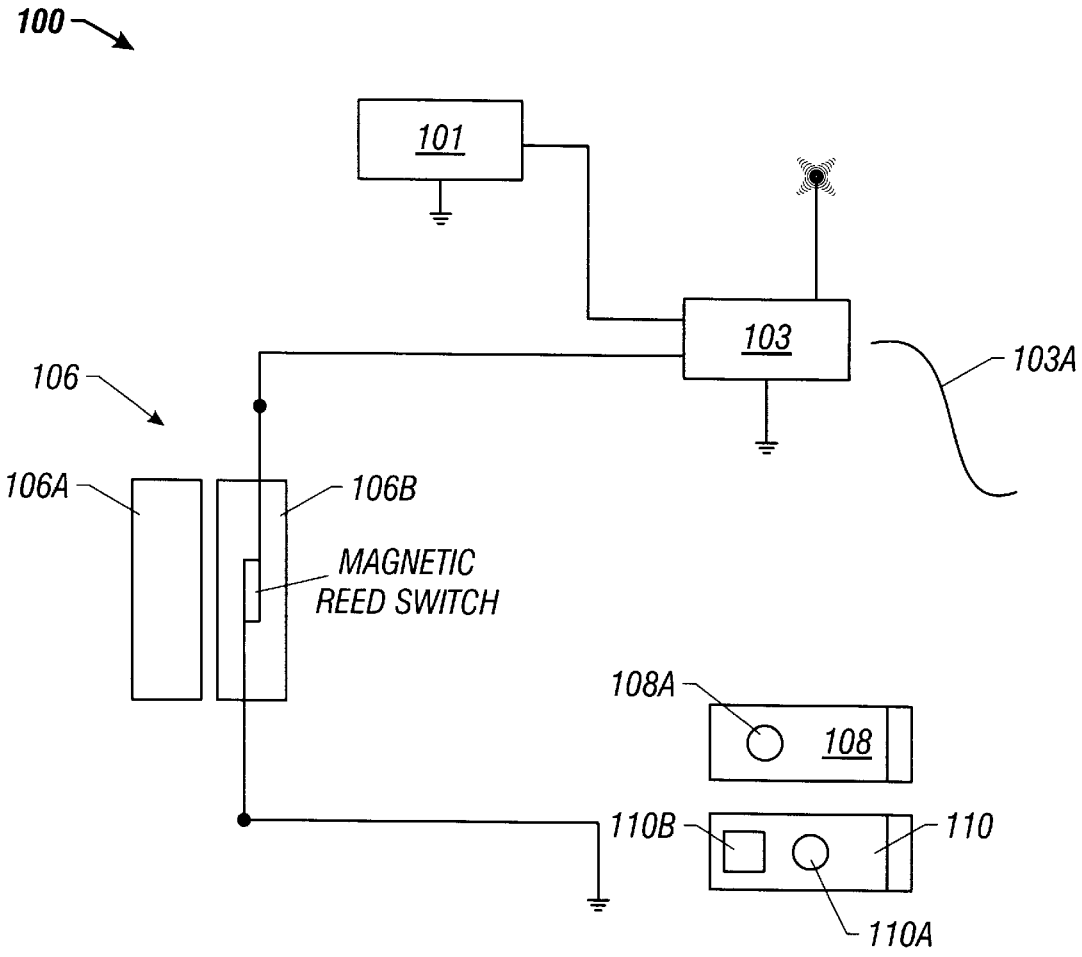
FIG. 1 is a schematic representation of signal generator 100 of the present invention which includes a power source 101, a transmitter 103, a switch 106, and a receiver 108 or 110, for receiving the signals 103A generated by transmitter 103.

Referring first to FIG. 1 there is shown a schematic diagram of signal generator 100 of the present invention. As shown in FIG. 1 signal generator 100 includes a power source 101, a transmitter 103, a switch 106 and a receiver 108 or 110, for receiving the signals 103A generated by transmitter 103.

Figure 2A:
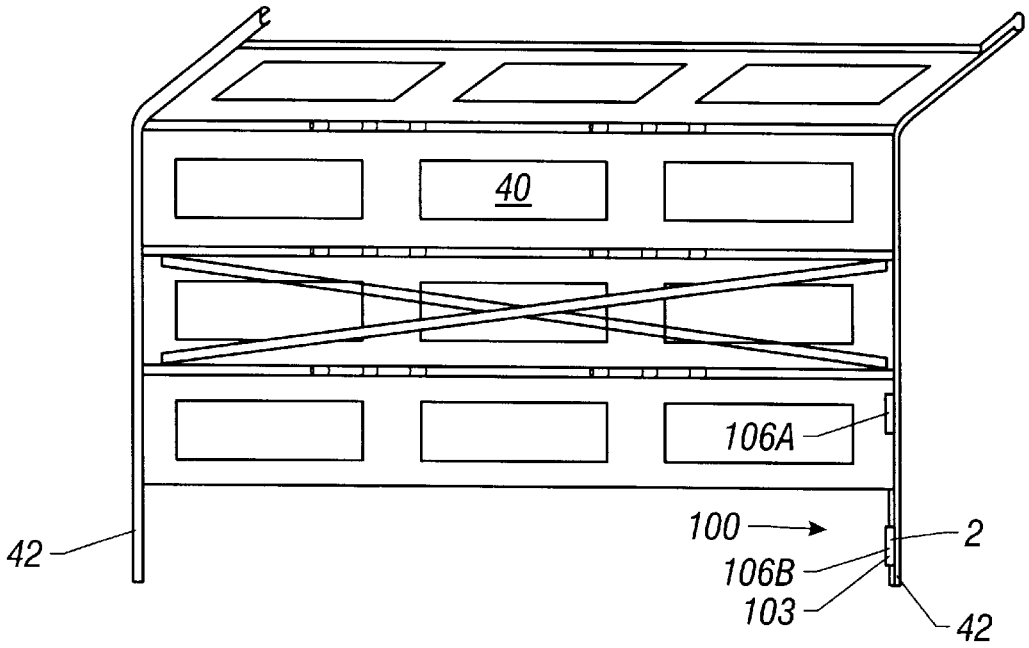
FIGS. 2A and 2B are illustrations showing the back and front of garage door 40 respectively, and the positioning of signal generator 100 thereon.
Figure 2B:
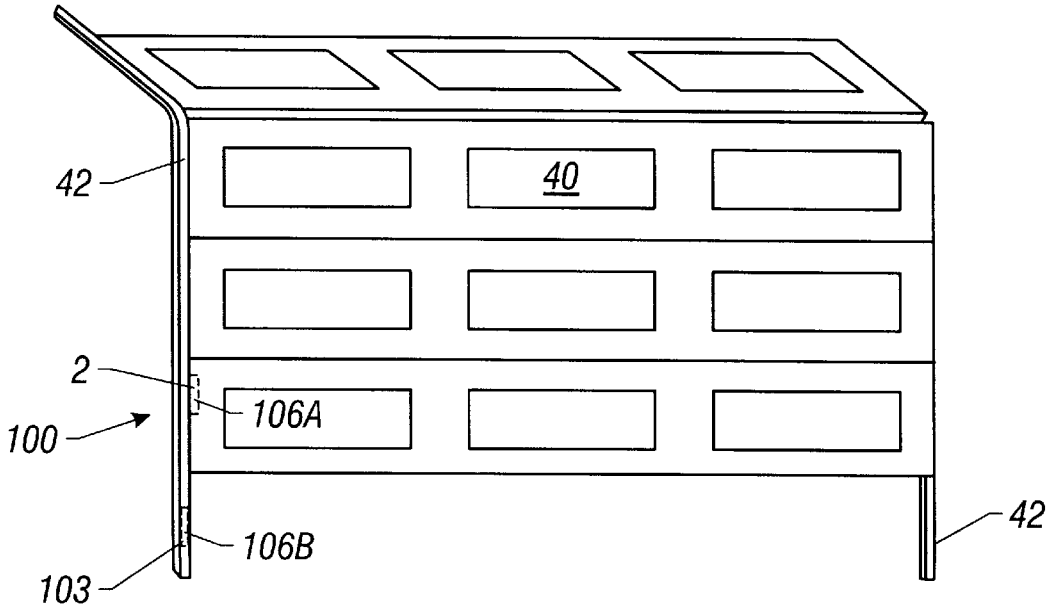

FIGS. 2A and 2B are illustrations showing the back and front of garage door 40 respectively, and the positioning of signal generator 100 thereon.

Figure 3:
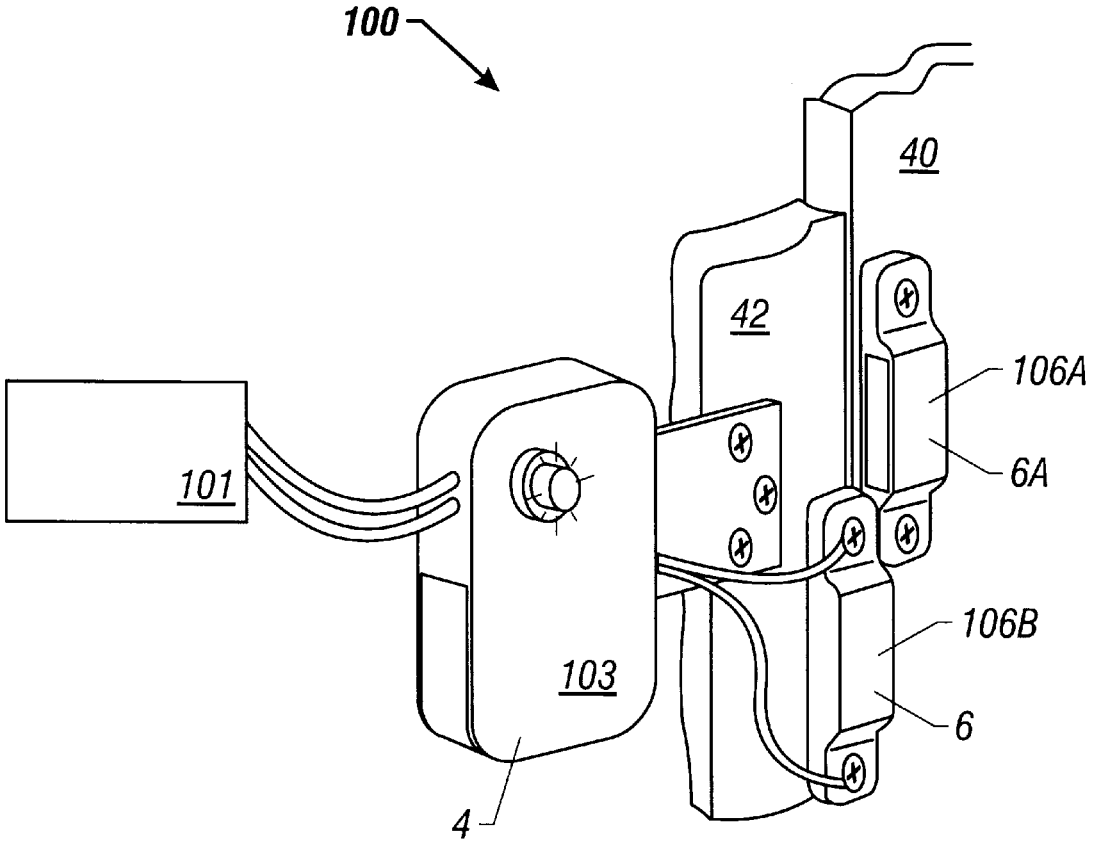
FIG. 3 is an illustration of one embodiment of signal generator 100 of the present invention showing one member 106B of switch 106 mounted on garage door frame 42 and the other member 106A of switch 106 mounted on garage door 40.

FIG. 3 is an illustration of one embodiment of signal generator 100 of the present invention showing one member 106B of switch 106 mounted on garage door frame 42 and the other member 106A of switch 106 mounted on garage door 40.

In the practice of the present invention it must be understood that power source 101 may be any power source suitable for powering signal transmitter 100, as the present invention is not to be limited to any particular type of power source 101. Power source 101 may provide either AC or DC current to system 100. As a non-limiting example, system 100 may be wired to or plugged into the electrical system of the garage. As another non-limiting example, power source 101 may also comprise of conventional batteries, or may also comprise rechargeable batteries which are constantly connected into the garage's electrical system. Power source 101 may further include one or more secondary or back-up power systems for providing electrical power in the event that the primary power system fails. Preferably, the power source 101 for signal generator 100 comprises a conventional 110 volt household circuit, or a 220 volt industrial type circuit. More preferably, power source 101 will further include a chargeable battery back-up system which is connected to and charged by the primary electrical circuit, and which will provide a limited source of power upon failure of the primary power.

Transmitter 103 is typically any suitable transmitter which will generate a suitable radio signal indicating that garage door 40 is closed, is opened, or both. For example, in the embodiment as shown in FIGS. 1–4, transmitter 103 only provides a signal that garage door 40 is closed, that is upon the closing of switch 106, and the lack of the signal would imply that garage door 40 is opened. In alternative embodiments not shown, a switch may be provided such that transmitter 103 only provides a signal that garage door 40 is opened, or more complicated switching may be provided such that transmitter 103 will generate one signal if garage door 40 is opened and another signal if garage door 40 is closed.

The present invention is not intended to be limited to any particular type of transmitter. It should be understood that transmitter 103 must be capable of generating a radio signal for at least a short distance away from the garage so that the homeowner may receive a signal from the transmitter as the homeowner is driving away from the house. Preferably, the transmitter 103 will be capable of generating a signal to a receiver positioned at least 50 yards away, more preferably at least 100 yards away, even more preferably at least a ¼ of a mile away, still more preferably at least a mile away, and yet more preferably at least 2 miles away.

It is believed that a wide range of frequencies may be suitable for use as signal 103A in the present invention.

However, it is believed that other factors, such as the crowdedness of frequency band, and governmental licensing restrictions and requirements may limit the practical choices for the frequency utilized. It is probably the case that governmental regulations and laws will dictate which frequencies may be utilized on both a licensed and non-licensed basis. For example, governmental restrictions in the United States may require the use of frequencies similar to those utilized by non-licensed low power walki-talkies, cordless telephones, and baby monitors, which are generally on the order of 49 MHz, although some cordless phones now operate at the higher 900 MHz frequency. It may also be possible to obtain a licensed frequency, which frequency would be dictated by the licensing body.

While not required, it may be desirable to utilize an encoded signal. This would reduce the chance that the receiver would be triggered by an errant signal from another device, or from another similar garage door system.

While it is believed that both an analog or digital signal may be utilized, a digital signal is preferred.

Although in the embodiment shown in FIG. 1, switch 106 is a magnetic reed type switch having a magnet portion 106A and a magnetic green switch 106B, it must be understood that any suitable switch may be utilized as switch 106 for the present invention. As one example, numerous types of switches utilizing one or more magnets are commercially available, and any are believed to be useful in the present invention. As another example, a suitable switch includes a typical contact type switch in which one of the contacting elements is mounted on the garage door frame and the other contacting element is mounted on the garage door. Although it is preferred that the two contacting elements be positioned such that they come into contact when the garage door is closed, alternatively, the two contacting elements may be positioned such that they come into contact only when the garage door is not fully closed. In a more complicated embodiment, switching may be provided in which one set of contacting elements is closed when the door is closed and open when the door is open, and another set of contacting elements is opened when the door is closed and closed when the door is opened.

In any event, the present invention is not to be limited to any particular type of switch as the inventor envisions that any suitable type of switch may be utilized. As a non-limiting example, a mercury-switch could be mounted at or near the upper most end of garage door 40 at end 40A, such that the mercury switch would be "switched" once garage door 40 reached its closed position. As another non-limiting example, a sensor, using light, radio or sound waves, could be utilized as switch 106 to detect that garage door 40 is opened and/or closed as desired.

It should also be understood that the positioning of the one more components of the selected switch 106 will be determined by the type of switch selected and is not intended to be limited to the garage door and door frame as illustrated. As a non-limiting example, for a contact-type switch, one contacting element may be provided in the leading edge of garage door 40, and the other contacting elements provided in the garage floor immediately beneath garage door 40 when it contacted the floor. As another non-limiting example, sensor type switches may be mounted anywhere inside or adjacent to the garage provided the sensor can still sense the garage door.

Signal 103A which is generated by transmitter 103 will be received by either a stand alone receiver 108 having an indicator 108A, or by a receiver which is incorporated into the remote garage door opener 110 having an indicator 110A. It is to be understood that stand alone receiver 108 or garage door opener 110 include standard conventional radio receiver circuitry which is designed upon receipt of signal 103A from transmitter 103 to activate either indicator 108A or 110A respectively. Stand alone receiver 108 may be battery operated or may be wired into the electrical circuitry of the automobile. The remote garage door opener 110 includes switch 110B for either opening or closing the garage door and indicator 110A, and it is generally battery powered.

Indicator 108A or 110A may omit a light signal, a sound signal, or a vibratory signal to alert the homeowner that the garage door has reached and is remaining in the closed position.

In an alternative embodiment, indicator 108A or 110A may omit a light signal, a sound signal, or a vibratory signal to alert the homeowner that the garage door did not reach the "closed" position. This may be accomplished by providing receiver 108 or remote controller 110 with circuitry that if a "closed" signal is not received within a set period of time after garage door 40 has been signaled to close, indicator 108A or 110A should so indicate, or by providing transmitter 103 or another transmitter with circuitry to generate an open signal if transmitter 103 does not generate a closed signal within a set period of time after garage door 40 has been signaled to close.

It should be noted that the present invention is not to be limited to any particular indicator or signal. As non-limiting examples, the light signal, sound signal or vibratory signal, may be a constant signal, increasing or decreasing signal, oscillatory signal, repeated on-off signal, and the like.

In a further embodiment, receiver 108 or garage door controller 110 may be provided with a second indicator or light which functions as a back-up to indicator 108A or 110A.

Referring now to FIGS. 2A and 2B there is shown back and front views respectively of a conventional garage door 40 supported by a framing 42. Not shown are a conventional motor and drive train mechanism which are used to move conventional garage door 40 along the frame 42. The signal generator 100 is mounted as generally shown in FIGS. 2A and 2B, with specific details provided in FIG. 3 which shows signal member 106A mounted on garage door 40 and signal member 106B and transmitter 103 mounted on framing 42.

I claim:

1. A garage door operating system comprising:

(a) a garage door supported by a frame, with a switch having a first component supported by the garage door, and a second component positioned to interact with the first component to provide an indication that the garage door is in a closed or non-closed position;

(b) a track along which the garage door is positioned and travels between non-closed and closed positions;

(c) a signal generator in communication with the switch which transmits at least one of a closed signal with the garage door in the closed position, or a non-closed signal with the garage door in the non-closed position; and (d) a remotely positioned indicator, positioned within a motor vehicle, which upon receipt of the signal transmitted from the signal generator in step (c), provides an indicator signal indicative whether the garage door is in the closed or non-closed position.

2. The system of claim 1, wherein the indicator signal is selected from among a light signal, sound signal, and vibratory signal is a light signal.

3. The system of claim 2, wherein the indicator signal is a light signal.

4. The system of claim 2, wherein the indicator signal is a light signal.

5. The system of claim 1, further including:

(e) a remote controller for controlling the travel of the garage door, in which is positioned the indicator.

6. The system of claim 5, wherein the indicator signal is selected from among a light signal, sound signal, and vibratory signal.

* * * * *